United States Patent [19]

Tyler

[11] 3,948,206

[45] Apr. 6, 1976

[54] JET POWERED WATERCRAFT

[75] Inventor: Nelson Tyler, Studio City, Calif.

[73] Assignee: Still Water Properties, N.V., Curacao, Netherlands Antilles

[22] Filed: Sept. 6, 1974

[21] Appl. No.: 503,603

[52] U.S. Cl. ..... 115/70

[51] Int. Cl.[2] ..... A63H 1/30

[58] Field of Search ..... 115/11, 12 R, 14–16, 115/70; 9/310 R, 310 A–310 E; 60/221–222; 114/66.5 H

[56] References Cited

UNITED STATES PATENTS

| | | | |
|---|---|---|---|
| 2,817,101 | 12/1957 | Chaffee | 115/70 |
| 2,940,409 | 6/1960 | Chaffee | 115/70 |
| 3,044,260 | 7/1962 | Hamilton | 115/16 |
| 3,157,146 | 11/1964 | Billig | 114/66.5 H |
| 3,158,129 | 11/1964 | Mauer | 115/70 |
| 3,233,573 | 2/1966 | Hamilton | 115/16 |
| 3,280,786 | 10/1966 | Rowell | 115/70 |
| 3,369,518 | 2/1968 | Jacobson | 115/70 |
| 3,394,673 | 7/1968 | Hamori | 115/70 |
| 3,397,670 | 8/1968 | Bedford | 115/70 |
| 3,426,724 | 2/1969 | Jacobson | 115/70 |
| 3,483,844 | 12/1969 | Trautwein | 115/70 |

FOREIGN PATENTS OR APPLICATIONS

| | | | |
|---|---|---|---|
| 1,276,009 | 8/1960 | France | 115/70 |
| 1,503,213 | 12/1966 | France | 115/70 |

*Primary Examiner*—Trygve M. Blix
*Assistant Examiner*—Jesus D. Sotelo
*Attorney, Agent, or Firm*—Fulwider Patton Rieber Lee & Utecht

[57] ABSTRACT

A jet powered watercraft of motorcycle-like configuration. Longitudinally aligned front and rear skis are located in spaced relation below a hull and operate to hydrodynamically lift the watercraft to a cruise position by relative water flow upon the undersides of the skis. The rear ski and a jet pump are secured as an integral unit to an engine. The rear ski includes an opening through which water passes to the jet pump, and further includes channels on either side of the opening to collect and carry away entrained air. The engine is located in the hull and is cooled by water supplied by the jet pump which it drives. The front ski is rotatable for steering and is resiliently extensible for stability in turning. The center of buoyancy of the watercraft is above its center of gravity so that the craft is self-righting. The exhaust and cooling systems are arranged to eliminate flooding despite location of portions of the engine below water when the craft is at rest. The jet pump discharge nozzle is completely out of the water in the cruise position of the craft for maximum thrust.

13 Claims, 13 Drawing Figures

JET POWERED WATERCRAFT

BACKGROUND OF THE INVENTION

1. Field of the Invention:

The present invention relates to a jet powered watercraft and more particularly to a watercraft utilizing aligned front and rear skis spaced below a hull and developing lift through the action of water against the ski undersides.

2. Description of Prior Art:

There have been many attempts in the past to provide a waterborne vehicle having a motorcycle-like configuration and characterized by generally the same handling characteristics as a motorcycle. Prior art attempts to produce a satisfactory vehicle have been largely unsuccessful for a number of reasons. The watercraft were either prohibitively expensive to manufacture, difficult to manuever, dangerous in operation due to use of conventional propellers, poor in performance or of short-lived durability.

Prior art motorcycle-like vehicles generally fall into one of two catagories, so-called hydrofoils, which provide lift by action of the water on a completely submerged foil, or hydroskids, which provide lift by action of the water primarily upon the underside of one or more skis riding upon the water surface. The hydrofoil designs are relatively more complex in that they must incorporate some means for controlling the height of the craft above the water.

The present invention is of the hydroskid type, the hydroskids or skis rising to the top of the water upon forward movement of the craft. The craft height is controlled solely by the skidding of the ski or skis upon the water surface.

Use of skis in conjunction with a jet pump presents certain problems. The turbulence generated by the skis as they ride across the water causes air to be entrained in the water moving toward the jet pump inlet. Air induction into the pump greatly detracts from its efficient operation.

A propulsive jet pump should be located such that its discharge nozzle is completely above and as close to the water surface as possible. This minimizes the incoming water path length to the pump and thereby reduces drag and keeps the jet pump above the water to also reduce drag. Such a location means that the jet pump must be disposed between the hull and the top of the rear ski, and consequently there must be a drive connection through the hull to the engine inside the hull. Such a connection poses a severe problem since connections of the engine and the pump to the hull pass their vibrations to the operator, and any flexure of the hull undesirably stresses the connection between the engine and the pump.

Other problems which must be met include the necessity for a self-righting characteristic. The vehicle must come into an upright position even when, for example, it may have just been forced into an upside down position. This means that the engine must be located relatively low in the hull to provide a center of gravity lower than the center of buoyancy. This in turn requires that the engine exhaust and cooling systems must not be susceptible to flooding even though the outside water level may be above most of the engine.

Because of these and other problems, prior art efforts to provide a suitable hydroskid or hydroski watercraft of the character indicated have failed.

SUMMARY OF THE INVENTION

According to the present invention, a jet powered watercraft is provided which employs aligned front and rear skis located in spaced relation below the hull and operative to hydrodynamically lift the watercraft by virtue of relative water flow against the ski undersides. The skis ride upon the water surface during forward propulsion of the craft by a jet which is located under the hull on top of the rear ski. The rear ski includes an opening through which water passes upwardly to the jet pump. The jet pump discharge nozzle is thus located above the water to reduce drag.

The drive means or engine for the jet pump is located within the lower part of the hull of the watercraft and helps establish the center of gravity of the craft below its center of buoyancy to provide a self-righting capability. A single opening in the hull provides all the through-hull connections. Its margins mount a perimetrically continuous sealing member or gasket whose opposite faces are engaged by the jet pump and the engine. No rigid connections are made of the engine and the pump to the hull. Instead, the engine and pump are bolted or fastened together as an integral unit, squeezing the gasket between them and against the hull opening margins to derive support from the hull. This isolates the pump and engine vibrations from the hull, provides a water-tight seal, and connects the pump and engine together as an integral unit so that any limited flexure of the hull does not affect the integrity of the drive connections between them.

The front ski is pivotable about a steering axis to steer the watercraft and is mounted to the hull by a linkage which enables extension and retraction of the front ski with attitude control, that is, with a predetermined control of the angle of inclination of the ski.

The rear ski is configured to include a pair of downwardly open channels or the like on either side of the pump inlet to receive and carry away entrained air before it reaches the pump inlet.

The engine compartment is vented through openings located to greatly reduce entry of unwanted water during forward propulsion. The engine exhaust and cooling systems each include conduit loops extending above the at-rest waterline of the craft to prevent flooding from the hull exterior by siphoning or otherwise.

The hull is preferably a monolithic structure providing the necessary buoyancy, with the engine-pump-rear ski assembly easily mounted thereto through a single hull opening. This greatly simplifies and speeds mass production of the craft.

DESCRIPTION OF THE PREFERRED EMBODIMENT

Figure 1:
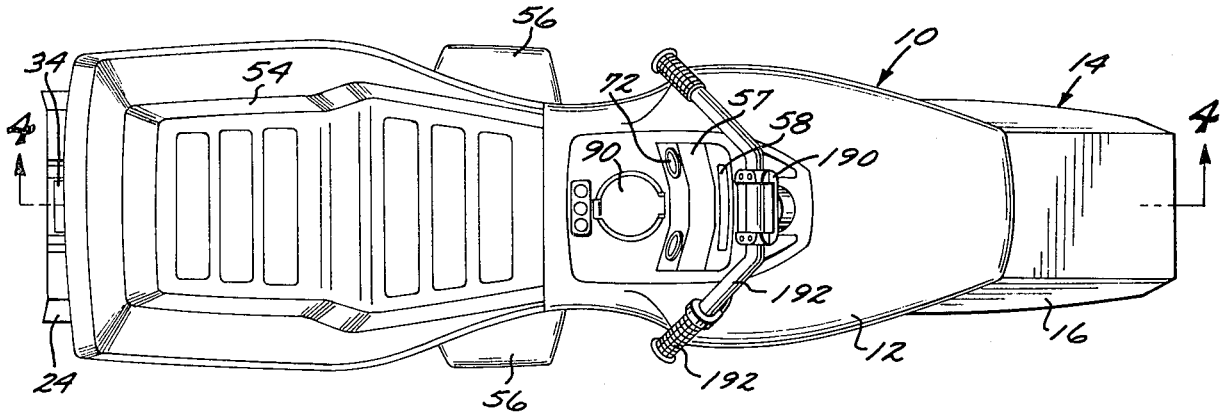
FIG. 1 is a top plan view of a jet powered watercraft according to the present invention.

Referring now to the drawings, and particularly to FIGS. 1 through 4, there is illustrated a jet powered watercraft 10 according to the present invention and comprising, generally, an elongated hull 12, a front ski assembly 14 having a front ski 16 located below and in spaced relation to the forward end of the hull 12, and a strut assembly 18 supporting the front ski 16 on the hull 12 for pivotal movement of the ski about a downwardly and forwardly inclined steering axis 20.

The watercraft 10 also comprises a rear ski assembly 22 having a rear ski 24 located below and in spaced relation to the rearward portion of the hull 12, and in longitudinal alignment with the front ski 16 when the watercraft is moving forwardly. The rear ski 24 is operative with the front ski 16 to hydrodynamically lift the watercraft from a displacement position in which the waterline is located as indicated at 26, to a cruise position in which the waterline is located as indicated at 28. Such lift occurs by virtue of relative waterflow upon the undersides of the skis 16 and 24. The term "undersides" is intended to be comprehensive enough to include any undersurface operative to ride upon the water surface, whether that surface is horizontal or inclined.

Figure 6:
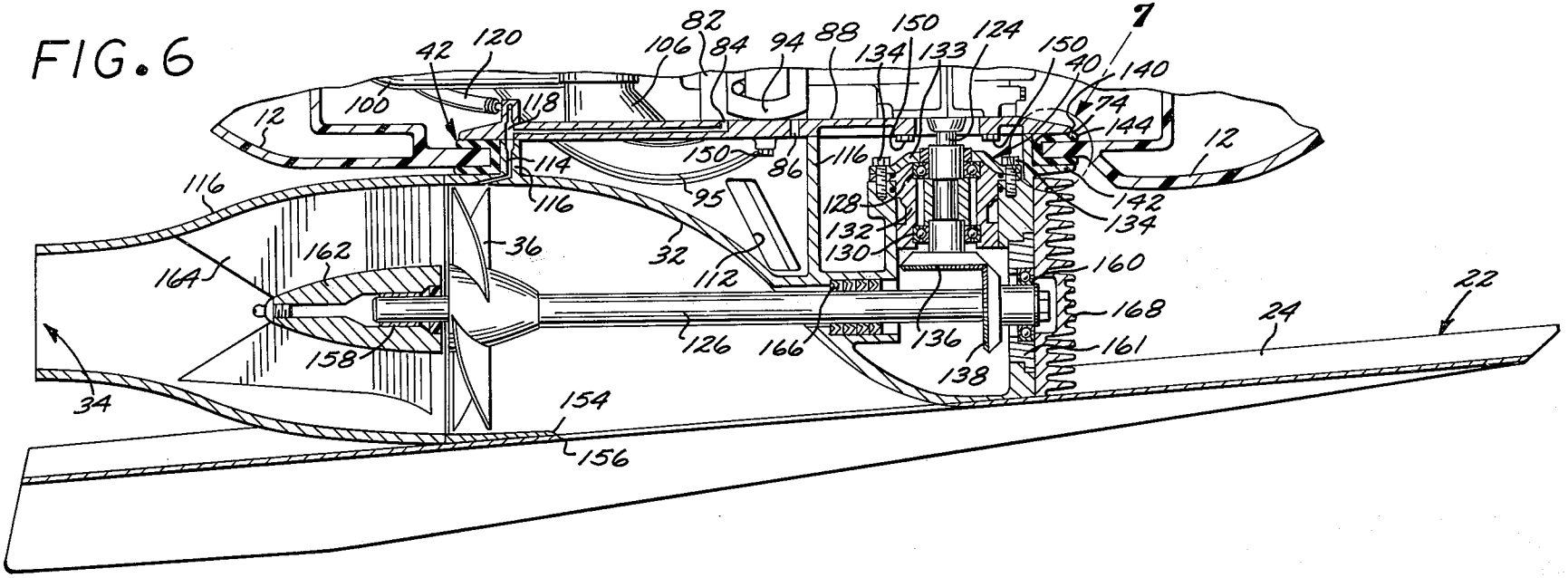
FIG. 6 is an enlarged longitudinal cross-sectional view of the jet pump and portions of the hull underside and rear ski.

As best seen in FIG. 6, the rear ski assembly 22 also includes a jet pump 30 having an inlet passage 32, a discharge nozzle 34, and an impeller 36 located in the inlet passage 32. The impeller 36 accelerates water out of the discharge nozzle 34 at high velocity to propel the watercraft 10 forwardly.

The watercraft 10 further includes a jet pump drive means or engine 38 which is located in the lower portion of the hull 12. A coupling means 40 connects the engine 38 to the pump 30 for rotation of the pump impeller 36. In addition, a mounting means, including a plate 88, integrally couples the rear ski assembly 22 to the engine 38 as an integral unit, and mounts both in a water-tight, low vibration relation to the hull 12, as will be seen.

HULL ARRANGEMENT

The hull 12 is generally elongate, streamline in configuration, and made of any suitable strong, lightweight material such as resin-reinforced glass fiber material, impact resistant molded plastic material, or the like. The configuration of the hull 12 is not critical and it may be made of a size and shape to suit individual requirements.

Figure 4:
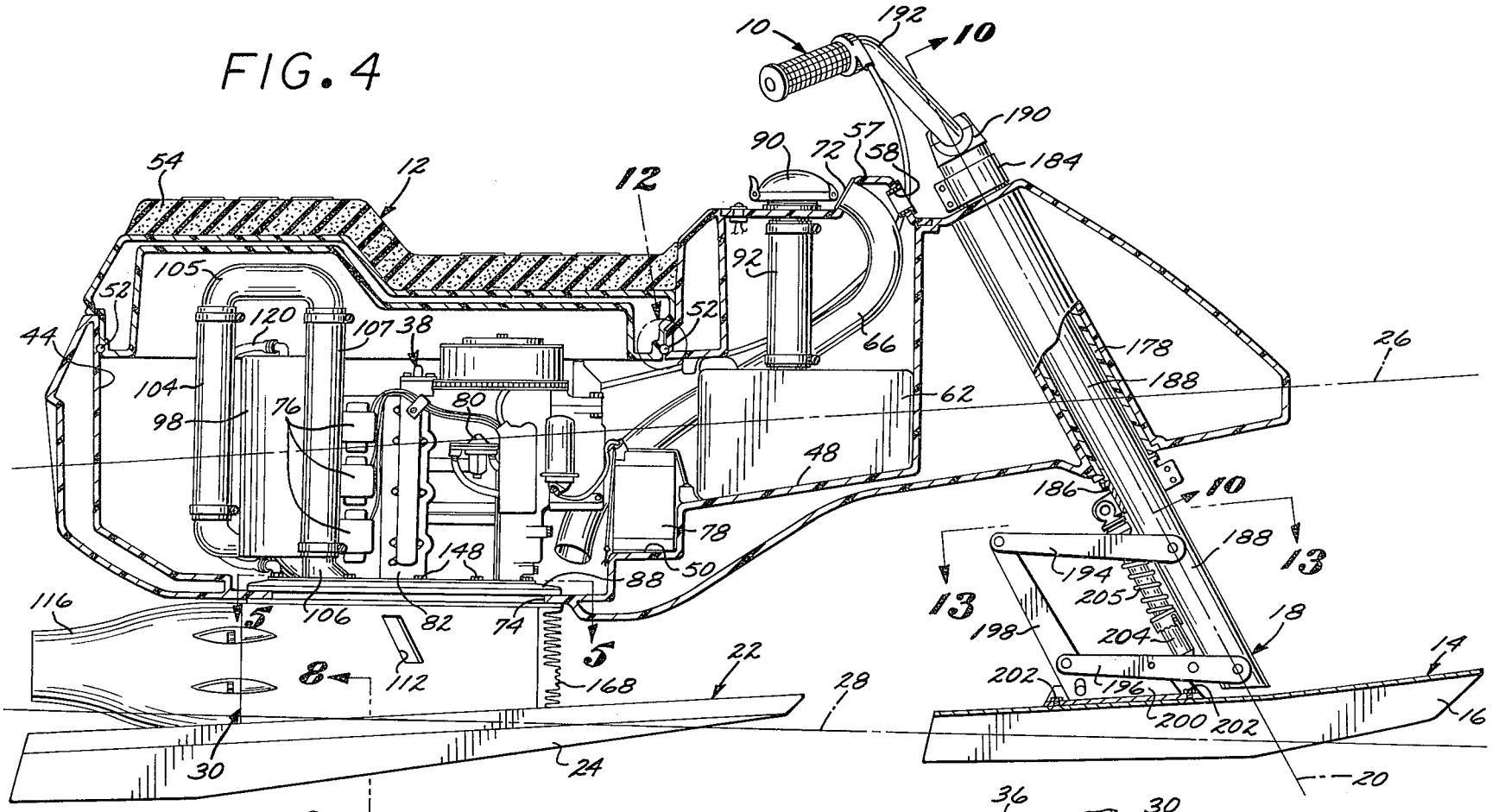
FIG. 4 is an enlarged longitudinal cross-sectional view.
Figure 12:
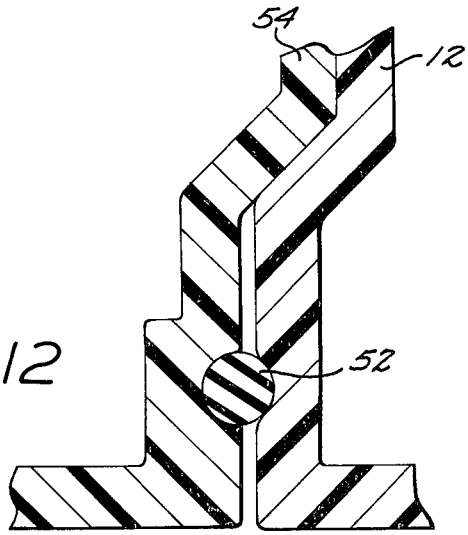
FIG. 12 is an enlarged detail cross-sectional view of the area indicated by the numeral 12 in FIG. 4.

In the embodiment illustrated, the hull 12 includes a generally enlarged central portion which defines an upwardly open engine compartment 44 having an integrally formed fuel tank shelf 48 and battery shelf 50. The upper perimeter of the engine compartment 44 includes a continuous channel which receives a resilient, continuous seal 52 made of rubber or the like, as best seen in FIGS. 4 and 12. The seal is closely received within a complemental groove formed in the lower perimeter of a seat assembly 54, which fits within and closes the open top of the engine compartment 44.

The seat assembly 54 includes edge margins which rest upon complemental hull portions for support, as seen in FIG. 4, and it is provided with suitable cushioning material for the comfort of the operator. The seat assembly 54 not only affords a seat for the operator, but also forms an engine compartment cover which completely seals the engine compartment 44 from the entry of water from the top.

Figure 2:
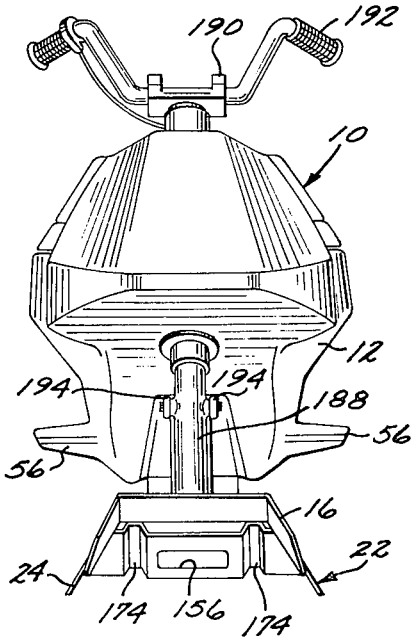
FIG. 2 is a front elevational view.
Figure 3:
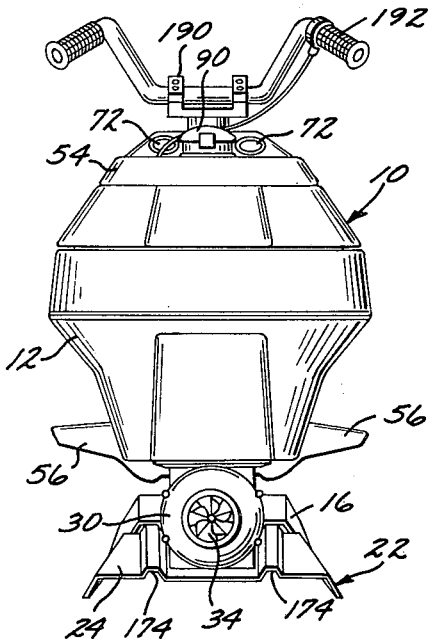
FIG. 3 is a rear elevational view.

As best seen in FIGS. 1 through 3, pegs or footrests 56 are integrally formed in the sides of the hull 12 to enable the operator to place his feet on support structure while he sits astride the seat assembly 54.

The forward extremity of the hull 12 is configured to define an upwardly sloping forward surface rearwardly of which is located a protuberance 57 having a forward facing air duct 58. Air entering the duct 58 passes into the engine compartment 44 to supply air to the engine and to flush fuel vapors out of the compartment through a pair of conduits 66. The upper ends of the conduits 66 discharge through rearwardly facing air vents 72 provided in the upper portion of the hull. The orientation of the air vents 72 tends to draw air through the outlet conduit 66 for venting of the engine compartment.

Other than the engine compartment opening covered by the seat assembly 54, the vent openings 58 and 72, and a mounting opening 74 in its base, as will be seen, the hull 12 is a completely sealed, monolithic structure in which the hull provides the buoyancy, and in which the center of gravity is below the center of buoyancy to provide a self-righting characteristic.

The engine compartment 44 houses the jet pump drive means or engine 38, which is preferably an internal combustion engine or the like having usual and conventional accessories and components such as ignition coils 76, a battery 78, a fuel pump 80, and an engine block 82. Inlet and outlet passages 84 and 86 are formed within a mounting plate 88 to which the engine 38 is bolted. Cooling water for the block 82 passes through the inlet passage 84 and the hot water from the block 82 is discharged through the outlet passage 86.

Since the construction and operation of the engine 38 are conventional, details respecting the same have been omitted for brevity. Generally, however, fuel for the tank 62 is admitted through a filler cap 90 and conduit 92. The fuel passes through any suitable carburetion system for combustion in the engine 38.

Figure 9:
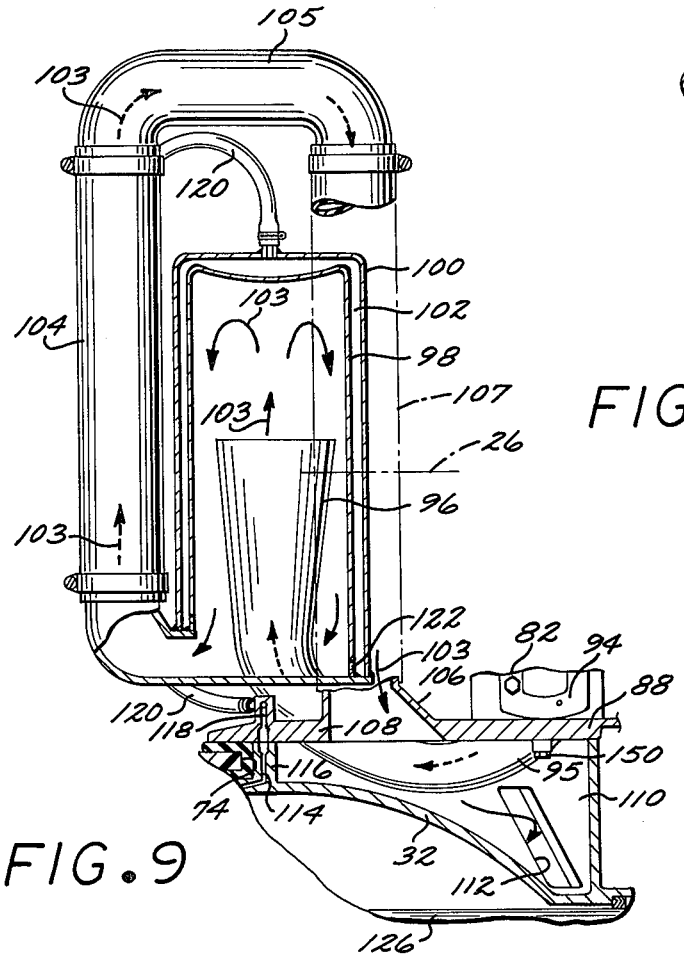
FIG. 9 is an enlarged view, partially in cross-section, of the muffler box and the associated exhaust and cooling system components.

As best seen in FIG. 9, exhaust gases from the engine pass through a usual exhaust manifold 94 and downwardly into a U-shaped conduit 95 which terminates in a flared, upwardly open exhaust cone 96. The cone 96 terminates within a double-walled, vertically extending cylindrical muffler box 98 having an outer wall 100. The double wall construction defines a cooling annulus 102 extending across the top of and completely around the box 98.

Exhaust gases entering the box 98 flow in the direction shown by the arrows 103 and exit the box 98 through an opening in the base in communication with an upwardly extending conduit 104. The conduit 104 is coupled to a conduit 105 of inverted U-shape which carries the gases into a downwardly extending exhaust conduit 107. At its base the conduit 107 is connected to a fitting 106 which is integral with the engine mounting plate 88 and which defines a discharge opening 108 through the plate 88. The opening 108 channels the gases into an exhaust chamber 110 formed between the plate 88 and a frame 116 of the rear ski assembly 22. The gases then pass to the exterior or atmosphere through diagonal side openings 112.

Cooling of exhaust gases passing through the muffler box 98 is achieved by sea water drawn by the jet pump impeller 36 through the jet pump inlet passage 32 and into a cooling passage 114 formed in the wall of the passage 32 and extending upwardly through an upwardly extending, perimetrically continuous, rectangular portion of the frame 116. This portion fits into or within the rectangular mounting opening 74 in the bottom of the hull 12.

From the passage 114 the cooling water flows into an adjacent passage 118 formed in the engine mounting plate 88. The cooling water then flows into a hose 120 connected to a port in communication with the passage 118. The hose 120 carries the water to the top of the muffler box annulus 102. From that point the water flows around the box and toward its bottom through the annulus 102. The water then enters the interior of the box 98 through a hole 122 provided in the inner wall of the box.

When the watercraft is at rest with the engine off, the water outside the hull 12 is at the level 26, as best seen in FIGS. 4 and 9. Exhaust gas cooling water cannot enter through the hose 120 and flood the engine because the upper loop of the hose 120 is above this level. Finally, water entering through the exhaust gas discharge opening 108 cannot flood the engine because the upper end of the conduit 107 is above the level 26.

When the engine 38 is in operation, the water level in the box 98 will be very low because of the pressure of exhaust gases. However, the water present is sufficient to muffle the sound of the engine 38. The incoming cooling water is drawn by the exhaust gases through the exhaust conduits 104, 105 and 107, through the discharge opening 108 and out of the side openings 112 along with the exhaust gases. This is also true of the cooling water from the engine block coming out of the outlet passage 86. It too is discharged out of the side openings 112 to atmosphere.

COUPLING MEANS

The engine crankshaft is vertically arranged. Its drive shaft 124 extends downwardly through the mounting plate 88 at a right angle to the drive shaft 126 of the impeller 36. The lower extremity of the engine drive shaft 124 is suitably journaled in upper and lower bearings 128 and 130 which are carried by a bearing structure 132 rigidly secured to the frame 116 by a plurality of threaded bolts 134, as best seen in FIG. 6.

A bevel gear 136 forming a part of the coupling means 40 is drivingly engaged with a complemental bevel gear 138 carried by the impeller shaft 126. The gears 136 and 138 provide a right angle drive connection between the shafts 124 and 126.

REAR SKI ASSEMBLY AND MOUNTING MEANS

The rear ski assembly 22 is rigidly connected to the engine 38 as an integral unit, the weight of both being borne by the hull 12 through the mounting means 42.

Figure 7:
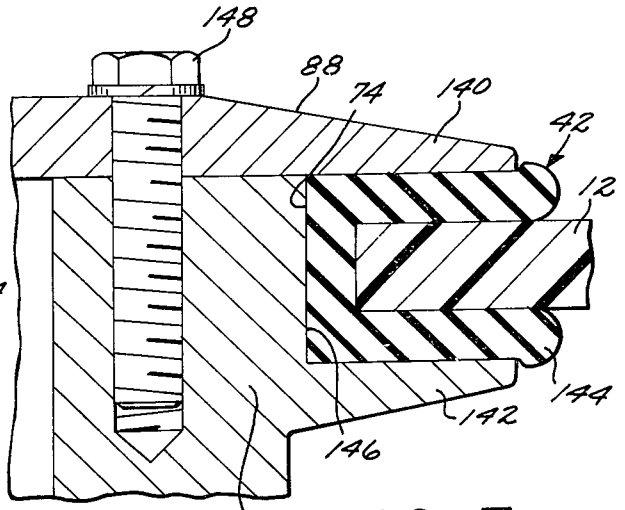
FIG. 7 is an enlarged view taken along the line 7—7 of FIG. 5.

More particularly, the edge margins of the rectangular engine mounting plate 88 define a perimetrical upper mounting portion 140 which overlies the margins of the mounting opening 74 in the hull 12, as best seen in FIGS. 6 and 7. Likewise, the frame 116 of the jet pump 30 includes a perimetrical lower mounting portion 142 which underlies the margins of the opening 74, opposite the mounting portion 140 and complemental thereto.

Figure 5:
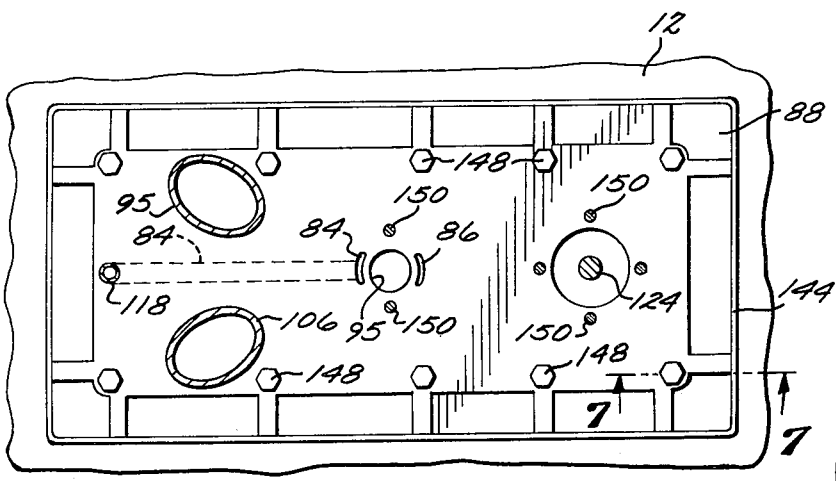
FIG. 5 is an enlarged view taken along the line 5—5 of FIG. 4.

A resilient, perimetrically continuous seal or gasket 144 is fitted onto the hull 12 between the portions 140 and 142. The gasket 144 is C-shape in transverse cross section and is therefore characterized by a perimetrical annulus or channel 146, as seen in FIG. 7, which receives the hull margins defining the opening. The upper and lower gasket legs are interposed, respectively, between the upper mounting portion 140 and the hull 12, and between the lower mounting portion 142 and the hull 12, respectively. A plurality of bolt fasteners 148 are disposed through the opposed portions 140 and 142, and comprise a portion of the mounting means 42 which secures the engine 38 to the rear ski assembly 22 as an integral unit, while simultaneously pressing against the gasket to effect a watertight, low vibration mounting to the hull 12. More particularly, as best seen in FIGS. 5 and 6, the fasteners 148 extend through the engine mounting plate 88 into suitable threaded bores in the rear ski assembly frame 116, and are tightened to urge the confronting portions 140 and 142 toward one another and against the interposed gasket 144. The watertight seal is acheived when the gasket 144 is squeezed against the margins of the hull opening 74.

With this arrangement, the integral, rigidly coupled assembly of the engine 38 and the rear ski assembly 22 cannot become misaligned by virtue of any deformation or flexure of the hull 12. This contrasts with the misalignment which might otherwise occur if the engine 38 and assembly 22 were independently attached to the hull.

The engine 38 and its associated components are secured to the engine mounting plate 88 by a plurality of suitable bolt fasteners 150 which extend upwardly through the plate 88 for threaded disposition within suitable threaded bores (not shown) provided in the engine and its components, as best seen in FIG. 5.

The rear ski assembly 22 comprises the rear ski 24 and the jet pump 30, as previously indicated. The jet pump frame 116, as best seen in FIG. 6, defines the internal inlet passage 32 and the rearwardly convergent discharge nozzle 34. Also, as previously indicated, the upper rectangular portion of the frame 116 fits within the mounting opening 74 for attachment of the rear ski assembly 22 to the engine 38.

The pump frame 116 is preferably cast or fabricated in two sections which are bolted together just aft of the impeller 36. The rearward frame section includes a rear bearing 158 and the forward frame section includes a forward bearing 160. The drive shaft 126 which mounts the impeller 36 is journaled for rotation in the bearings 158 and 160.

The rear bearing 158 is carried within a streamline center section 162 supported by usual stators 164 extending radially outwardly and attached to that portion of the pump inner wall which extends rearwardly to define the discharge nozzle 34.

The forward bearing 160 is carried within a suitable opening provided in a mounting plate 161 which is disposed within a larger opening provided in the forward wall of the pump frame 116. Suitable packing 166 is provided to afford a water-tight seal where the impeller drive shaft 126 extends through the pump inlet passage wall, as best seen in FIG. 6.

The frame 116 is cast to define a cylindrical well below the vertical drive shaft 124 which receives the bearing support 132 for the bearings 128 and 130. A bearing retainer 133 is secured to the bearing support 132 by a plurality of bolts 134, which also secure the retainer 133 and the support 132 to the wall of the frame well.

The forward portion of the pump frame 116 is provided with a removable front cover 168 secured in position by usual bolts (not shown). Removal of the cover 168 affords immediate access to the bearings 160, gears 136 and 138 and their associated components for maintenance purposes.

Figure 8:
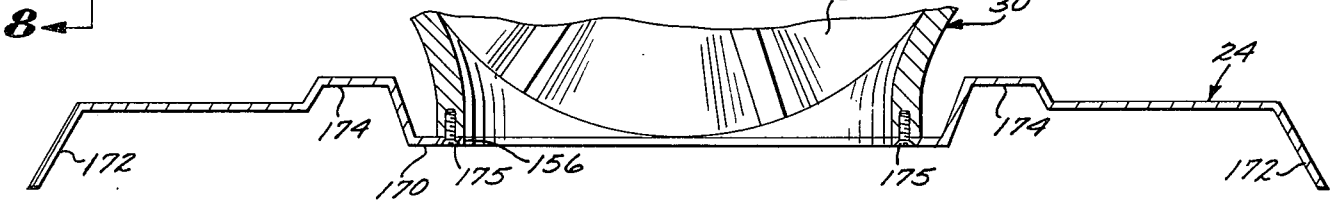
FIG. 8 is an enlarged view taken along the line 8—8 of FIG. 4.

The rear ski 24 is generally of concave or inverted U-shape, as best seen in FIGS. 4, 6 and 8. It includes a generally flat, longitudinally extending central portion 170 provided with an opening 156 in communication with an opening 154 located in the pump frame 116 and providing a water passage to the jet pump inlet passage 32. Between the central portion 170 and the ski side legs 172 are located a pair of downwardly open tunnels or channels 174 which are adapted to receive and carry away air which may be entrained in the water flowing past the ski 24. Entry of such entrained air into the jet pump 30 adversely affects its performance and the channels 174 tend to collect and divert a great portion from the pump 30.

The ski 24 is made of any suitable material, such as aluminum plate, and is secured to the underside of the jet pump 30 by a plurality of threaded fasteners 175.

The longitudinal axis of the ski 24, that is, an axis lying within the plane of the underside of the central portion 170, extends in a generally upward and forward direction relative to the water surface in the cruise position of the watercraft indicated by the numeral 28 in FIG. 4. In this orientation the axis of the water discharge from the pump 30 is generally parallel to the water surface. This provides optimum propulsion for the watercraft 10. A slight inclination of the ski 24 is necessary to provide hydrodynamic lift, while jet pump propulsion along an axis generally parallel to the water surface is most efficient.

Location of the jet pump 30 above the rear ski 24 and below the hull 12 places it in the best position for most efficient propulsion and minimum drag. It is completely out of the water in the cruise position of the watercraft 10, and yet it is immediately adjacent the engine 38 for optimum drive coupling. Moreover, although a right angle drive connection is provided between the engine 38 and the jet pump 30, any deflection of the intermediate hull structure does not affect the integrity of this coupling because of the utilization of the mounting means 42, as previously described. The gasket 144 also provides vibration isolation and a water-tight seal. The particular combination, location and interconnection of the engine 38, the mounting means 42, the jet pump 30 and the rear ski 24 thus provides efficient propulsion with minimum drag and minimum vibration, and with minimum effect upon the engine and pump interconnection.

FRONT SKI ASSEMBLY AND STRUT ASSEMBLY

Figure 10:
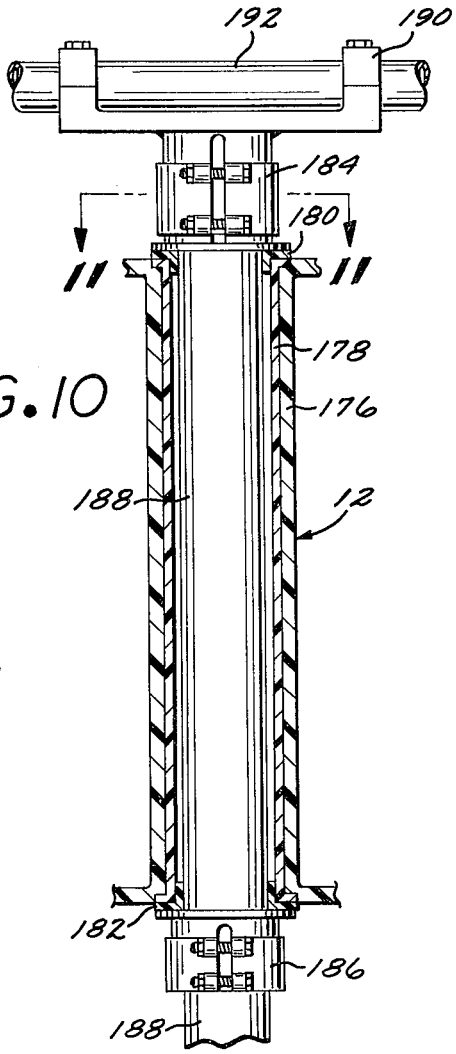
FIG. 10 is a view taken along the line 10—10 of FIG. 4.
Figure 11:
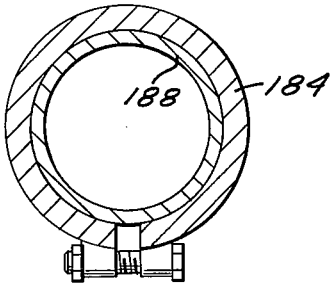
FIG. 11 is a view taken along the line 11—11 of FIG. 10.

As best seen in FIGS. 4, 10, and 11, the hull 12 includes an integral, downwardly and forwardly extending cylindrical sleeve 176 which is molded in as an integral part of the hull 12. The sleeve 176 encompasses a tubular shroud 178 provided with upper and lower bushings 180 and 182. The bushings rotatably engage upper and lower clamp supports 184 and 186 which are clamped to an elongated steering shaft 188. The steering shaft 188 is rotatable about the downwardly and forwardly inclined steering axis 20, and is constrained against axial movement by the supports 184 and 186.

The upper end of shaft 188 mounts a handlebar yoke 190 which carries a handlebar 192. Rotation of the handlebar 192 rotates the shaft 188 to steer the watercraft 10. The handlebar 192 includes conventional throttle controls for adjusting the speed of the engine 38, such as is common on motorcycles.

Figure 13:
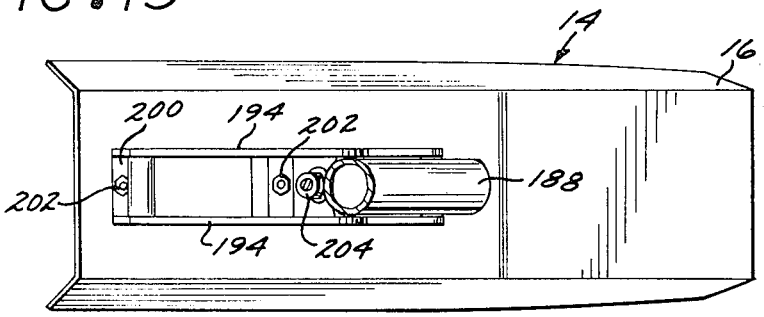
FIG. 13 is a view taken along the line 13—13 of FIG. 4.

As best seen in FIGS. 4 and 13, the lower end of shaft 188 is not directly attached to the front ski 16, but rather pivotally mounts the forward ends of two pairs of generally horizontally oriented and vertically spaced apart arms 194 and 196. The rearward ends of the upper pair of arms 194 and the rearward ends of the lower pair of arms 196 are pivotally secured to an upward extension 198 of a bracket whose base 200 is secured to the ski 16 by a plurality of fasteners 202. The arms 194 and 196, the extension 198 and the steering shaft 188 comprise the front strut assembly 18 previously mentioned as providing the support for the front ski 16 on the hull 12.

The arms 194 and 196 can be made of equal length, in which case the front ski 16 can extend and retract relative to the steering shaft 188 without attitude change. If desired, the arms can be made of different lengths to provide a predetermined change in ski attitude, as will be apparent.

The ski 16 is normally biased to an extended position by a shock strut 204 which has its upper end secured to the lower clamp support 186, and its lower end pivotally secured to the lower pair of arms 196. The shock strut 204, which includes a compression spring 205, tends to resiliently extend the front ski 16. It also incorporates a conventional shock absorber fluid damping system to damp extension and retraction of the ski 16. With this arrangement the ski 16 automatically extends to reduce skidding during turning of the watercraft 10, and resiliently retracts and extends on encountering rough water or the like.

The front ski 16 is longitudinally elongated and arranged at approximately the same angle of inclination as the rear ski 24. It is also made of the same material as the rear ski 24, but differs somewhat in configuration, as best seen in FIGS. 4 and 13. It is of generally inverted U-shape with a flat central portion and outwardly and downwardly inclined legs or side channels.

OPERATION

At rest the watercraft 10 is buoyed by its hull 12 to the displacement position indicated by the waterline 26. The operator sits astride the seat assembly 54 with his feet resting on the foot pegs 56. When the engine is started and the throttle is advanced the engine 38 rotates the drive shafts 124 and 126. This rotates the impeller 36, and the reaction of the expelled water from the discharge nozzle 34 thrusts the watercraft 10 forwardly. Forward speed increases to the point that the action of the water flowing against the undersides of the front and rear skis 16 and 24 hydrodynamically lifts the watercraft 10 to the cruise position indicated by the waterline 28.

During forward movement the vehicle can be turned by manipulating the handlebars 192 to rotate the steering shaft 188 and the front ski 16. The linkage 194, 196, and 198, together with the shock strut 204, enables the front ski 16 to accommodate itself to the turning movements and to any rough water conditions encountered.

The jet pump 30 rides essentially completely out of the water, above the rear ski 24, so that water is ejected along an axis closely adjacent and above the surface of the water.

Forward movement of the watercraft 10 induces a flow of fresh air through the air duct 58, into the interior of the engine compartment 44, and then outwardly through the conduits 66 and the air vents 72.

Cooling water is urged to the impeller 36 through the passages 114 and 118, the hose 120, and into the muffler box annulus 102. The exhaust gases within the muffler box 98 are cooled by this water. The water then enters the interior of the muffler box 98 through the passage 122. Exhaust gases passing upwardly and out of the exhaust cone 96 force the accumulated water within the muffler box 98 through the exhaust conduits 104, 105, and 107, through the discharge opening 108, and finally to the atmosphere through the side openings 112 provided in the pump frame 116.

Cooling water for the engine manifold is also urged by the impeller 36 through the passage 114. From there it flows through the passage 84 to the engine block 82, and exits through the outlet passage 86 to the atmosphere through the side openings 112.

The watercraft 10 is characterized by optimum propulsion efficiency, minimum drag, ease of production, integrity of drive connections, good manueverability, ready accommodation to rough seas, self-righting, and minimum through-hull openings.

Various modifications and changes may be made with regard to the foregoing detailed description without departing from the spirit of the invention.

I claim:

1. A jet powered watercraft comprising:

a hull including an engine compartment providing buoyancy;

a front ski assembly including a front ski located below and in spaced relation to said hull and further including means supporting said front ski on said hull for pivotal movement about a steering axis to steer the watercraft;

a rear ski underlying said engine compartment and operative with said front ski to hydrodynamically lift the watercraft to a cruise position above its displacement position by virtue of relative water flow upon the planing surfaces of said front and rear skis, said rear ski having an opening;

jet pump drive means located in said engine compartment;

a jet pump operative to receive water through said opening and accelerate the water for discharge at high velocity to propel the watercraft forwardly, said jet pump being located below said jet pump drive means, said jet pump further being located above said planing surface of said rear ski whereby said jet pump is located above the water surface in said cruise position; and coupling means connecting said jet pump drive means to said jet pump for operation of said jet pump.

2. A jet powered watercraft according to claim 1 wherein said means of said front ski assembly support said front ski for extension and retraction of said front ski in its entirety relative to said hull.

3. A jet powered watercraft according to claim 1 wherein said hull includes a mounting opening, and further comprising mounting means mounting said jet pump drive means and said jet pump on opposite sides of said mounting opening in resilient relation to said hull, said mounting means further mounting said jet pump directly to said jet pump drive means in non-resilient relation.

4. A jet powered watercraft according to claim 1 wherein said rear ski is generally of downwardly concave shape, including a longitudinally extending central portion which includes said opening, said central portion and the side portions of said rear ski defining a pair of downwardly open channels adapted to receive and carry away air which might otherwise pass into said opening.

5. A jet powered watercraft according to claim 1 wherein the center of gravity of said jet pump drive means, said jet pump, and said front and rear skis is located below the center of buoyancy of said hull whereby said watercraft is self-righting.

6. A jet powered watercraft according to claim 1 wherein the longitudinal axis of said rear ski is generally upwardly and forwardly inclined relative to the water surface upon attainment of said cruise position, and wherein the axis of said discharge from said jet pump is generally parallel to said water surface in said cruise position.

7. A jet powered watercraft according to claim 1 wherein said jet pump drive means includes an engine having a vertically oriented drive shaft, said jet pump is located externally of said hull and said discharge therefrom is generally along a horizontal axis in said cruise position, and said coupling means includes a right angle drive connection.

8. A jet powered watercraft comprising:

a hull including a mounting opening;

a front ski assembly including a front ski located below and in spaced relation to said hull and further including front strut means supporting said front ski on said hull for pivotal movement about a steering axis to steer the watercraft, said front ski having an underside;

a rear ski assembly including a rear ski located below and in spaced relation to said hull, said rear ski having an upper side and an underside and being operative with said front ski to hydrodynamically lift the watercraft to a cruise position above its displacement position by virtue of relative water flow upon the undersides of said front and rear skis, said rear ski assembly further including a jet pump having an inlet passage, a discharge nozzle and an impeller operative in said inlet passage to receive and accelerate water for passage at high velocity out of said discharge nozzle to propel the watercraft forwardly, said jet pump being mounted above said upper side of said rear ski and externally of and below said hull whereby said jet pump is located above the water surface in said cruise position, said jet pump including a lower mounting portion underlying the margins defining said mounting opening;

jet pump drive means located in said hull and including coupling means connected to said jet pump for operation of said impeller, and further including an upper mounting portion overlying the margins defining said mounting opening; and mounting means mounting said rear ski assembly to said hull and to said jet pump drive means, said mounting means including a resilient, perimetrically continuous gasket having an annulus receiving the edges of said margins defining said mounting opening and having upper and lower legs interposed, respectively, between said upper mounting portion and said margins and between said lower mounting portion and said margins, and said mounting means further including a plurality of fasteners drawing together said upper and lower mounting portions.

9. A jet powered watercraft comprising:

a hull including a mounting opening;

a front ski assembly including a front ski located below and in spaced relation to said hull and further including front strut means supporting said front ski on said hull for pivotal movement about a steering axis to steer the watercraft, said front ski having an underside;

a rear ski assembly including a rear ski located below and in spaced relation to said hull, said rear ski having an upper side and an underside and being operative with said front ski to hydrodynamically lift the watercraft to a cruise position above its displacement position by virtue of relative water flow upon the undersides of said front and rear skis, said rear ski assembly further including a jet pump having an inlet passage, a discharge nozzle and an impeller operative in said inlet passage to receive and accelerate water for passage at high velocity out of said discharge nozzle to propel the watercraft forwardly, said jet pump being mounted above said upper side of said rear ski and externally of and below said hull whereby said jet pump is located above the water surface in said cruise position;

jet pump drive means located in said hull and including coupling means connected to said jet pump for operation of said impeller; and mounting means mounting said rear ski assembly to said hull and to said jet pump drive means, said mounting means including a gasket carried by the margins defining said mounting opening, and further including a plurality of fasteners carried by and drawing together said jet pump drive means and said jet pump into an integral assembly and against said gasket for the sole support of said rear ski assembly upon said hull.

10. A jet powered watercraft comprising:

a hull;

a front ski assembly including a front ski located below and in spaced relation to said hull and further including front strut means supporting said front ski on said hull for pivotal movement about a steering axis to steer the watercraft, said front ski having an underside;

a rear ski assembly including a rear ski located below and in spaced relation to said hull, said rear ski having an upper side and an underside and being operative with said front ski to hydrodynamically lift the watercraft to a cruise position above its displacement position by virtue of relative water flow upon the undersides of said front and rear skis, said rear ski being of generally downwardly concave shape and including a longitudinally extending central portion having an inlet opening therethrough in communication with said inlet passage, said central portion and the sides of said rear ski defining a pair of downwardly open channels adapted to receive and carry away entrained air which might otherwise pass into said inlet opening, said rear ski assembly further including a jet pump having an inlet passage, a discharge nozzle and an impeller operative in said inlet passage to receive and accelerate water for passage at high velocity out of said discharge nozzle to propel the watercraft forwardly, said jet pump being mounted above said upper side of said rear ski and externally of and below said hull whereby said jet pump is located above the water surface in said cruise position;

jet pump drive means located in said hull and including coupling means connected to said jet pump for operation of said impeller; and mounting means mounting said rear ski assembly to said hull and to said jet pump drive means.

11. A jet powered watercraftt comprising:

a hull including an upwardly open engine compartment having an upper perimeter including a resilient, continuous seal, said hull further including a seat assembly fitted within said engine compartment, said seat assembly having a continuous channel receiving said seal and deforming said seal to provide a waterproof fit therebetween;

a front ski assembly including a front ski located below and in spaced relation to said hull and further including front strut means supporting said front ski on said hull for pivotal movement about a steering axis to steer the watercraft, said front ski having an underside;

a rear ski assembly including a rear ski located below and in spaced relation to said hull, said rear ski having an upper side and an underside and being operative with said front ski to hydrodynamically lift the watercraft to a cruise position above its displacement position by virtue of relative water flow upon the undersides of said front and rear skis, said rear ski assembly further including a jet pump having an inlet passage, a discharge nozzle and an impeller operative in said inlet passage to receive and accelerate water for passage at high velocity out of said discharge nozzle to propel the watercraft forwardly, said jet pump being mounted above said upper side of said rear ski and externally of and below said hull whereby said jet pump is located above the water surface in said cruise position;

jet pump drive means located in said engine compartment and including coupling means connected to said jet pump for operation of said impeller; and mounting means mounting said rear ski assembly to said hull and to said jet pump drive means.

12. A jet powered watercraft comprising:

a hull;

a front ski assembly including a front ski located below and in spaced relation to said hull and further including front strut means supporting said front ski on said hull for pivotal movement about a steering axis to steer the watercraft, said front ski having an underside, said front strut means including a downwardly and forwardly inclined steering shaft and a parallelogram linkage mounting said front ski to said shaft for extension and retraction of said front ski relative to said steering shaft and providing attitude control of said front ski;

a rear ski assembly including a rear ski located below and in spaced relation to said hull, said rear ski having an upper side and an underside and being operative with said front ski to hydrodynamically lift the watercraft to a cruise position above its displacement position by virtue of relative water flow upon the undersides of said front and rear skis, said rear ski assembly further including a jet pump having an inlet passage, a discharge nozzle and an impeller operative in said inlet passage to receive and accelerate water for passage at high velocity out of said discharge nozzle to propel the watercraft forwardly, said jet pump being mounted above said upper side of said rear ski and externally of and below said hull whereby said jet pump is located above the water surface in said cruise position;

jet pump drive means located in said hull and including coupling means connected to said jet pump for operation of said impeller; and mounting means mounting said rear ski assembly to said hull and to said jet pump drive means.

13. A jet powered watercraft comprising: a hull;

a front ski assembly including a front ski located below and in spaced relation to said hull and further including front strut means supporting said front ski on said hull for pivotal movement about a steering axis to steer the watercraft, said front ski having an underside;

a rear ski assembly including a rear ski located below and in spaced relation to said hull, said rear ski having an upper side and an underside and being operative with said front ski to hydrodynamically lift the watercraft to a cruise position above its displacement position by virtue of relative water flow upon the undersides of said front and rear skis, said rear ski assembly further including a jet pump having an inlet passage, a discharge nozzle and a impeller operative in said inlet passage to receive and accelerate water for passage at high velocity out of said discharge nozzle to propel the watercraft forwardly, said jet pump being mounted above said upper side of said rear ski and externally of and below said hull whereby said jet pump is located above the water surface in said cruise position;

jet pump drive means located in said hull and including coupling means connected to said jet pump for operation of said impeller;

exhaust gas and cooling water conduits connected to said jet pump drive means and communicating with the exterior of said hull below the waterline in said displacement position of said watercraft, said jet pump including exhaust gas ports, said exhaust gas and cooling water conduits including loops extending above said waterline to prevent flooding therethrough and said exhaust gas conduit communicating with said exhaust gas ports for discharge of the exhaust gases above the water surface in said cruise position; and mounting means mounting said rear ski assembly to said hull and to said jet pump drive means.

* * * * *